United States Patent [19]

Plovie

[11] Patent Number: 4,662,629

[45] Date of Patent: May 5, 1987

[54] EXERCISE DEVICE

[76] Inventor: Bartholomew Plovie, 707 Donald, Royal Oak, Mich. 48073

[21] Appl. No.: 652,060

[22] Filed: Sep. 19, 1984

[51] Int. Cl.[4] ..... A63B 1/00

[52] U.S. Cl. ..... 272/62; 272/900; 182/206; 248/214

[58] Field of Search ..... 272/900, 62, 93, 134, 272/109, 111, 112, 113; 248/215, 340, 214; 182/206; 434/254

[56] References Cited

U.S. PATENT DOCUMENTS

| | | | |
|---|---|---|---|
| 956,835 | 5/1910 | Taulman | 248/214 X |
| 2,666,640 | 1/1954 | Jennings, Sr. | 2723/63 |
| 2,854,292 | 9/1958 | Schaeffer | 182/206 X |
| 2,919,918 | 1/1960 | Horn | 272/60 |
| 3,077,347 | 2/1963 | Nova | 272/60 |
| 3,430,953 | 3/1969 | Teetor | 272/900 X |
| 3,591,173 | 7/1971 | Cossman | 272/60 |
| 3,879,033 | 4/1975 | Martin | 272/60 R |
| 4,018,437 | 4/1977 | LoPresti | 272/112 X |
| 4,133,524 | 1/1979 | Barlew | 272/111 |
| 4,232,863 | 11/1980 | Roach | 272/111 |
| 4,327,907 | 5/1982 | DeVries | 272/93 |
| 4,412,677 | 11/1983 | Viramontes | 272/62 |
| 4,419,990 | 12/1983 | Forster | 272/900 |
| 4,458,894 | 7/1984 | Dudley | 272/900 X |
| 4,548,294 | 10/1985 | Ruda et al. | 182/206 |

FOREIGN PATENT DOCUMENTS

| | | | |
|---|---|---|---|
| 2315291 | 1/1977 | France | 272/62 |

OTHER PUBLICATIONS

"Deluxe Hip Flexor"—Universal Exercise Equipment Catalogue, 1980-1981, p. 18.

*Primary Examiner*—Richard J. Apley
*Assistant Examiner*—Robert W. Bahr
*Attorney, Agent, or Firm*—Basile, Weintraub & Hanlon

[57] ABSTRACT

A door or partition mounted exercise device for exercising muscles of the arms and upper body. The device includes an exercise portion attached to a mounting apparatus. The exercise portion is composed of a pair of parallel lateral support members extending perpendicularly from a centrally located transverse positioning bar. A pair of beam members extend perpendicularly downward from the lateral support members when the exercise device is in a vertical position. A pair of lower support legs extending perpendicularly from the beam members in an orientation parallel to the lateral support members. The mounting apparatus is a pair of parallel members upon which the transverse positioning rod can be affixed. The upper ends of the parallel members are formed into hooks which can be mounted over the top of a conventional door. The lower end of the parallel members extend perpendicularly outward to form projections extending into the terminal ends of the lower support legs opposing the beam members. An individual uses the device by grasping the beam members with his hands and pulling his body up and down. The exercise portion can also be used independently of the mounting apparatus on a horizontal surface.

5 Claims, 3 Drawing Figures

EXERCISE DEVICE

BACKGROUND OF THE INVENTION

1. Field of the Invention

The present invention relates to exercise devices. More particularly, this invention relates to portable devices mounted on a door or other perpendicular object for exercising the upper body.

2. Description of the Prior Art

Various devices have been used to facilitate physical exercise. Many of these devices are designed to allow a person to exercise by lifting his own weight. Pull-up bars, parallel beams, suspending rings, etc. are all designed to support the weight of the person during physical exercise. The individual using such devices can exercise various muscles of the upper body by lifting himself against the force of gravity. Many exercise devices such as parallel beams and suspended rings require complementary support structures available only in gymnasiums.

Portable devices such as pull-up bars which are wedged in a doorway cannot always be reliably positioned. Many times these devices fail when the user's weight is exerted on them causing a grave risk of injury to the user. Additionally, rod-like pull-up bars do not provide the user with the maximum exercise efficiency possible when the user employs parallel bars or rings.

Various portable exercise devices using parallel support members have been proposed. Most of these devices, such as those disclosed in U.S. Pat. No. 4,232,863 to Roach and U.S. Pat. No. 2,666,640 to Jennings are designed to aid floor exercises. These devices do not provide the type of exercise available when suspended exercise apparatus is used.

SUMMARY OF THE INVENTION

The present invention, which will be described in greater detail subsequently, is an exercise device having a mounting means for removably positioning the device over the top of a door or other suitable partition. A transverse positioning bar is connected to the mounting means. Two transversely spaced parallel lateral support members are located at either end of the transverse positioning bar perpendicularly oriented in and separated from each other by the length of the transverse positioning bar. The lateral support members are supported in position by beam members which extend perpendicularly and downwardly from the lateral support members. Lower support legs extend inward from the beam members and are parallel to the lateral support members. The exercise device is used by grasping each beam member with one hand and raising and lowering the body thereby exercising various muscles of the upper body.

The mounting means is a pair of bars forming elongated mounting member attached to the transverse positioning unit extending perpendicularly upward and downward from it. At the uppermost edge the bars comprising the mounting means are bent into two 90° angles to form a pair of U-shaped hooks which can be situated over an existing door or other partition. The device is suspended on the door at a suitable height for the user. The lower ends of the bars forming the mounting means have a support projection which extends into hollows formed in the inwardly extending lower support legs to help maintain their orientation during use. The terminal ends of the lower support legs are in abutting relationship with the lower end of the elongated mounting members. The terminal ends of the lower support legs are held in position by a projection extending from the lower ends of the parallel bars comprising the mounting members into a hollow in the terminal ends of the beam members.

It is a primary object of the present invention to provide a new, improved portable exercise device for use in exercising the upper body.

It is another object of the present invention to provide a portable, adjustable exercise device for use in exercising the upper torso which provides a pair of spaced beams located in parallel which permits the user to raise and lower himself therebetween.

Further objects advantages and applications of the present invention will become more apparent to those skilled in the art of exercise devices for the accompanying description when it is read in conjunction with the accompanying drawings.

BRIEF DESCRIPTION OF THE DRAWING

The description herein makes reference to the accompanying drawing wherein like reference numbers refer to like parts through the various views and wherein.

DESCRIPTION OF THE PREFERRED EMBODIMENTS

Figure 1:
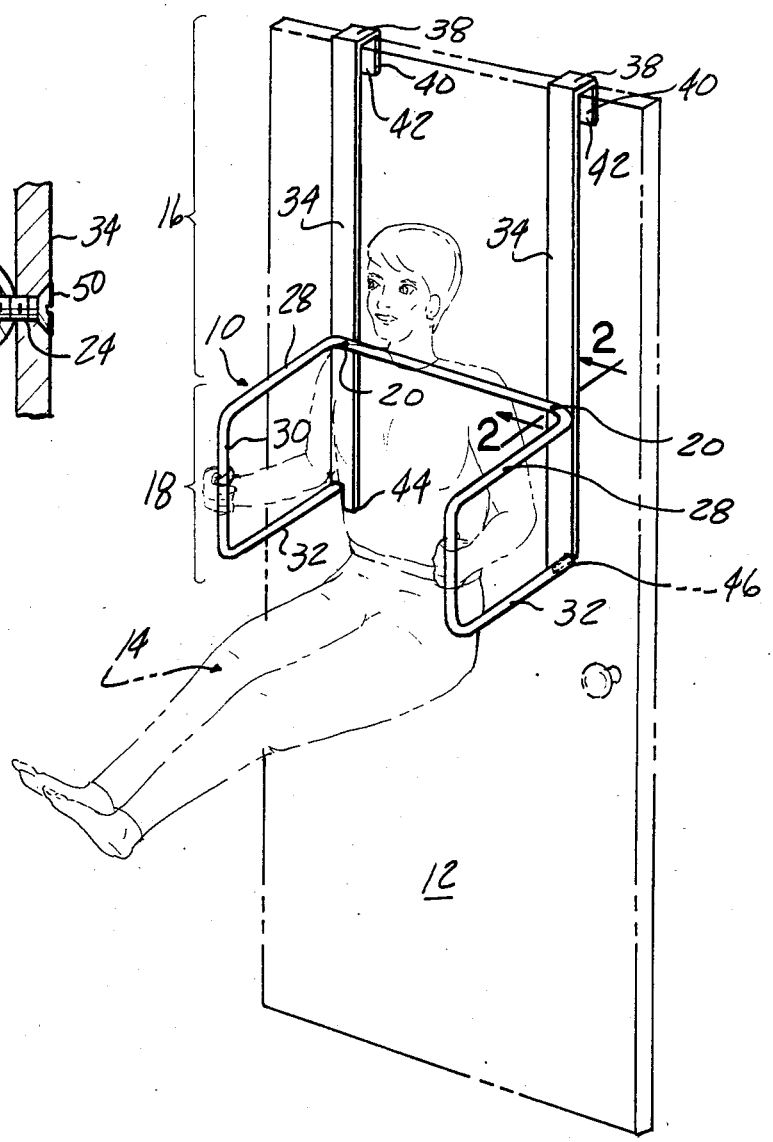
FIG. 1 is a perspective view of the portable exercise device of the present invention mounted to a door with the user shown in phantom.

As shown in FIG. 1, the exercise device 10 is adapted to be mounted on a conventional door 12 or other appropriate partition in a manner which will be described in greater detail subsequently. In this orientation an individual 14, shown in phantom, can use the device 10 to perform various exercises for strengthening and toning the arm and upper torso muscles. The portable exercise device 10 comprises a mounting means 16 and exercise portion 18 and an upper attachment means 20 and a lower attachment means (FIG. 3) for connecting the mounting means 16 to the exercise portion 18.

A transverse positioning bar 22 of the exercise portion 18 has two ends and is attached to the door mounting means 16 by upper attachment means 20 located at positions proximate to the two ends of the transverse positioning bar 22. Two lateral support members 28 extend from the two ends of the transverse positioning bar 22. The lateral support members 28 are oriented at right angles with the transverse positioning bar 22 and are oriented perpendicular to the mounting means 16. The transverse positioning bar 22 is of suitable length to create sufficient distance between the lateral support members 28 to allow an individual's body to pass comfortably between. In the preferred embodiment, this is 5.75 ft. Extending downward from the transversely spaced lateral support members 28 are beam members 30. The distance between the two beam members is a distance substantially the same as the distance between the lateral support members 28. A pair of lower support legs 32 extend inwardly from the beam members to contact the mounting means 16. The lower support legs 32 are positioned essentially perpendicular to the mounting means 16 and are essentially parallel to the lateral support members 28.

In the preferred embodiment the exercise portion 18 is composed of an internal piece of cylindrical metal tubing which can be bent into the desired shapes to define the transverse positioning bar 22, the pair of lateral support members 28, the pair of beam members 30 and the pair of lower support legs 32. The tubing is of appropriate thickness and composition and width to provide structural stability while providing a low weight. Alternately, the exercise portion 18 can be comprised of separate elements suitably secured by appropriate fastening means such as bolts or welds. In order to form the structure described, the exercise portion 18 may also be constructed of suitable high-strength plastic or fiberglass.

The door mounting means 16 may be constructed in any manner which provides a secure removable attachment for the exercise device 10 to the door 12. In the preferred embodiment, the door mounting means 16 is comprised of a pair of parallel bars 34. Preferably, the parallel bars 34 are made from flat metal strips which are bent to form the component elements. Alternately, the parallel bars 34 can be made from suitable flattened metal tubing or lengths of high-strength plastic to provide suitable characteristics of lightweight and durability. When a thin gauge metal is used to form the paralel bars 34, reinforcing strip to provide suitable strength and durability. One such material is wood. Also desirable and included in the preferred embodiment is a protective backing affixed to the surfaces of the parallel bars which contact the door 12. The backing can be made of polymeric foam or cloth.

Each bar is comprised of elongated member 36, an upper perpendicular member 38 and a rear extension 40. These elements, when combined on the parallel bars form hooks 42 which secure the exercise device 10 to the door 12 by resting over the top portion of the door 12 when it is in a closed position. The hooks may be made of flattened tubing, flat sheets of metal or suitable plastic sufficiently thin to permit the door 12 on which the exercise device 10 is mounted to close. The hooks may have a protective backing affixed to the side of the hook contacting the door. The backing may be made of polymeric foam or cloth. The hooks 42 may be integrally constructed from the parallel bars 34, as in the preferred embodiment or they may be constructed separately and joined to the parallel bars 34.

Figure 3:
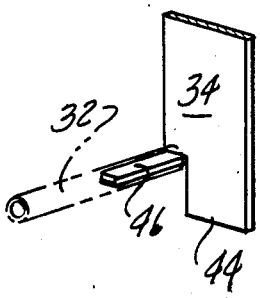
FIG. 3 is a perspective view of the lower attachment means showing the support projection from the parallel bar for maintaining the lower support leg in proper orientation.

The elongated members 36 have lower ends 44 opposed to the ends bearing the hooks 42. As best seen in FIG. 3, the lower ends 44 have outwardly bending projections 46 which extend into hollows contained in the lower support legs in the form of a pin. The projection provides adequate support when downward pressure is exerted on the lower support legs 32.

Figure 2:
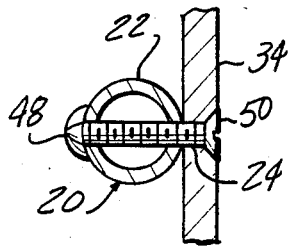
FIG. 2 is a cross-section view of the upper attachment means taken through the 2—2 line in FIG. 1.

The attachment means 20 is best seen in FIG. 2. The transverse positioning bar 22 is connected to the pair of parallel bars 34 at a position above the lower end 44 of the parallel bars 34. This connection point is sufficiently removed from the lower end 44 of the parallel bars to permit the terminal end of the lower support legs 32 to abut the parallel bars 34 when the exercise portion 18 of the devices is permanently secured.

A parallel bar 34 is connected to the transverse positioning bar 22 by means of a bolt or screw-like device 24. In the preferred embodiment a flathead bolt is threaded through the parallel bar 34 and the transverse positioning bar 22. The screw-like device 24 is held in place by a rounded cap or nut 48 which positioned over the end of the bolt protruding from the transverse positioning bar 22. The flathead 50 of the screw-like device 24 is positioned flush with the surface of the parallel bar 34.

In order to use the exercise device 10. The hooks 42 of the mounting means 16 are positioned over the top of a door 12, as illustrated in FIG. 1. The door 12 is closed when the device 10 is used. The individual positions himself between the parallel beam members 30, grasping them with his hands. From this position, he can raise and lower himself by using the muscles of his arms or upper torso.

It can be seen from this disclosure that the present invention provides a new and unique protable exercise device which can be used at home or office without requiring the complex gymnastic equipment or support devices. It can also be seen by one skilled in the art that the portable exercise device of the present invention is simple in design and easy and economical to manufacture.

What is claimed is:

1. An exercise device comprising:

a transverse positioning bar;

a pair of lateral support members extending perpendicularly from the transverse positioning bar and parallel to one another;

a pair of beam members extending downwardly from the lateral support members and parallel to one another;

a pair of lower support legs extending from the beam members in an essentially perpendicular direction positioned essentially parallel below the lateral support members, the lower support legs having terminal ends opposed to the beam members;

means for mounting the exercise device in an operative position wherein the mounting means comprises a pair of parallel bars each bar including:

an elongated positioning rod having lower and upper ends, the lower end being adapted to receive the transverse positioning bar and the terminal ends of the lower support legs;

an upper perpendicular member extending perpendicularly from the upper end of the elongated positioning rod; and rear extension extending perpendicularly from the upper perpendicular member opposed to and in parallel to the elongated positioning rod; and means for attaching the exercise device to the mounting means.

2. An exercise device comprising:

a transverse positioning bar;

a pair of lateral support members extending perpendicularly from the transverse positioning bar and parallel to one another;

a pair of beam members extending downwardly from the lateral support members and parallel to one another;

a pair of rigid hollow tubular lower support legs extending from the beam members in an essentially perpendicular direction positioned essentially parallel below the lateral support members, the lower support legs having terminal ends opposed to the beam members wherein the transverse positioning bar, lateral support members, base members and lower support legs are integrally formed from a continuous piece of material:

means for mounting the exercise device in an operative position wherein the mounting means comprises a pair of parallel bars, each bar having a hook positioned to releasably attach over an upper portion of a door or the like;

means for attaching the exercise device to the mounting means, said attaching means comprising:

a perpendicular projection extending from said parallel bars into the interior of the terminal ends of the lower support legs;

a flathead bolt extending through the parallel bars to engage and secure the transverse positioning bar, the flathead bolt being flush with the surface of the parallel bars; and a not connected to the flathead bolt engaging the transverse positioning bar and securing it.

3. An exercise device comprising:

(a) an exercise portion capable of being used on a horizontal surface having:

a transverse positioning bar;

a pair of lateral support members extending perpendicularly from the transverse positioning bar and parallel to one another;

a pair of beam members extending downwardly from said lateral support members and parallel to one another;

a pair of lower support legs extending from the beam members in an essentially perpendicular direction positioned essentially parallel below the lateral support members, the lower support legs having terminal ends opposed to beam members;

(b) means for mounting the exercise device in an operative position to a substantially vertical surface; and (c) means for releasably attaching the exercise portion to the mounting means including upper and lower connections, the upper connections comprising:

a flathead bolt extending through the mounting means to engage and secure the transverse positioning bar, the flathead bolt being flush with the surface of the mounting means; and a roundhead not connected to the flathead bolt engaging the transverse positioning bar and securing it.

4. The exercise device of claim 3 wherein the releasable attaching means has upper and lower connections, the lower connections comprising:

the lower support legs, each having an aperture formed in the terminal end abutting the mounting means; and the mounting means having an appropriately positioned perpendicular projection extending into the interior of the aperture.

5. An exercise device comprising:

a transverse positioning bar;

a pair of lateral support members extending perpendicularly from the transverse positioning bar and parallel to each other;

a pair of beam members extending downwardly from the lateral support members and in parallel to one another, a pair of lower support legs extending perpendicularly from the beam members and positioned parallel to and below the lateral support members, the lower support legs having hollow terminal ends opposed to the beam members;

a means for mounting the exercise device in an operative position, the means comprising a pair of parallel bars, each bar including an elongated positioning rod having lower and upper ends, the lower end adapted to receive the transverse positioning bar and terminal ends of the lower support legs, an upper perpendicular member extending integrally and perpendicularly from the upper perpendicular member opposed to and in parallel to the elongated positioning rod;

means for attaching the exercise device to the pair of parallel bars comprising a flathead bolt extending through the pair of parallel bars to secure the transverse positioning rod, the flathead bolt flush with the surface of the mounting means, fastened by a roundhead nut;

the lower ends of the parallel bars each having a perpendicular projection extending outward into the hollow terminal ends of the lower support legs.

* * * * *